US007458405B1

(12) United States Patent
Gaffney

(10) Patent No.: US 7,458,405 B1
(45) Date of Patent: Dec. 2, 2008

(54) GOLF CLUB HEAD COVER AND TOWEL

(76) Inventor: John H. Gaffney, 425 RioSalado Pkwy. #202, Tempe, AZ (US) 85281

( * ) Notice: Subject to any disclaimer, the term of this patent is extended or adjusted under 35 U.S.C. 154(b) by 183 days.

(21) Appl. No.: 11/490,724

(22) Filed: Jul. 20, 2006

(51) Int. Cl.
*A63B 57/00* (2006.01)

(52) U.S. Cl. ..... 150/160; 206/315.4; 15/209.1

(58) Field of Classification Search ..... 150/159, 150/160; 206/315.2, 315.4; 15/209.1
See application file for complete search history.

(56) References Cited

U.S. PATENT DOCUMENTS

| | | | | |
|---|---|---|---|---|
| 3,128,812 | A | 4/1964 | Scheurer | |
| 3,638,284 | A | 2/1972 | Baker | |
| 3,831,652 | A | 8/1974 | Hyden | |
| 3,938,570 | A | 2/1976 | Stewart | |
| 4,898,222 | A | 2/1990 | Gaffney | |
| 4,912,800 | A * | 4/1990 | Zeltner | 15/114 |
| 5,215,136 | A | 6/1993 | Flanders | |
| 5,280,798 | A | 1/1994 | Helm | |
| 5,394,914 | A | 3/1995 | Meek | |
| 5,407,723 | A | 4/1995 | Curtin | |
| 5,771,523 | A * | 6/1998 | Rudolph | 15/209.1 |
| 5,816,396 | A | 10/1998 | Shin | |
| 6,138,727 | A | 10/2000 | Shih | |
| 6,463,971 | B1 | 10/2002 | Kinsey | |
| 2007/0094826 | A1 * | 5/2007 | Chandler et al. | 15/209.1 |

FOREIGN PATENT DOCUMENTS

| | | | |
|---|---|---|---|
| EP | 1287859 | A1 * | 3/2003 |
| JP | 2005253923 | * | 9/2005 |

* cited by examiner

*Primary Examiner*—Sue A Weaver
(74) *Attorney, Agent, or Firm*—Booth Udall, PLC

(57) ABSTRACT

A combination golf club head cover and towel includes a head cover which is open on the heel side of a golf club head to facilitate slipping it over the head. Mating first and second fasteners are attached to the edges adjacent the shaft to secure the cover around the shaft. A towel with at least a third fastener on an edge or corner thereof is releasably secured to a portion of at least one of the fasteners on the head cover to releasably hold the towel in place on the head cover both when the head cover is on the head of a golf club, or is removed from the golf club head.

12 Claims, 4 Drawing Sheets

GOLF CLUB HEAD COVER AND TOWEL

BACKGROUND

The invention illustrated in the enclosed embodiment of this application relates to head covers for golf clubs, and more particularly, to a combination of a head cover and a towel. Golf club head covers currently are extensively used to protect the golf club heads during transport and storage, and at all times until the particular club is to be used in conjunction with the play of a game of golf. Covers are especially used for putters because of the relatively high cost of putters and the desire to protect the face of the putter from scratches and nicks.

A putter cover which has been found to be particularly handy for use, because of its ease of placement and removal, is the putter cover of applicant's U.S. Pat. No. 4,898,222. This putter cover has an open back on it with matching hook-and-loop strips on opposite sides, which allow the putter cover to be closed over the shaft of the putter club when the club is placed in the bag for storage. Removal of the cover of U.S. Pat. No. 4,898,222 is readily effected by pulling apart the attached hook-and-loop strips, either by pulling on opposite sides of the cover adjacent the strips, or by simply pulling the cover forward over the toe of the putter to cause the heel and the shaft to open the hook-and-loop strips, effectively opening and removing the putter cover in one continuous motion.

Another important accessory used in the play of the game of golf is a small towel or wiper, typically in the form of terry cloth or other absorbent material for use in cleaning a club head or putter club head and the golf ball. Such towels also are used by the golfer to clean perspiration from his or her hands prior to using a golf club or putter. Golfers frequently place a towel in a pocket of their wearing apparel; but some golf apparel does not have pockets for carrying a towel. In such a case, the towel must be carried separately in some other way. Fasteners have been provided on the golf bag or on the golf cart for temporarily and releasably holding a towel; but such locations are not entirely convenient.

A number of patents have been granted for combinations of a putter head cover and a towel. Generally, the configuration of the combined towel/head cover is such that the resultant basically is a specially shaped towel, which, when not in use, also surrounds or covers the putter head. Obviously, when such a combination towel/putter head cover becomes soiled and in need of laundering, the entire putter head cover/towel combination must be removed from the putter to effect the necessary laundering. This leaves the putter head unprotected during whatever time is required for laundering. Such combination putter cover/towels, however, do have an advantage in that the towel is associated with the most frequently used club in the bag of golf clubs.

It is desirable to provide a combination of a towel and a putter head cover which overcomes the disadvantages of the prior art noted above.

DETAILED DESCRIPTION

Figure 1:
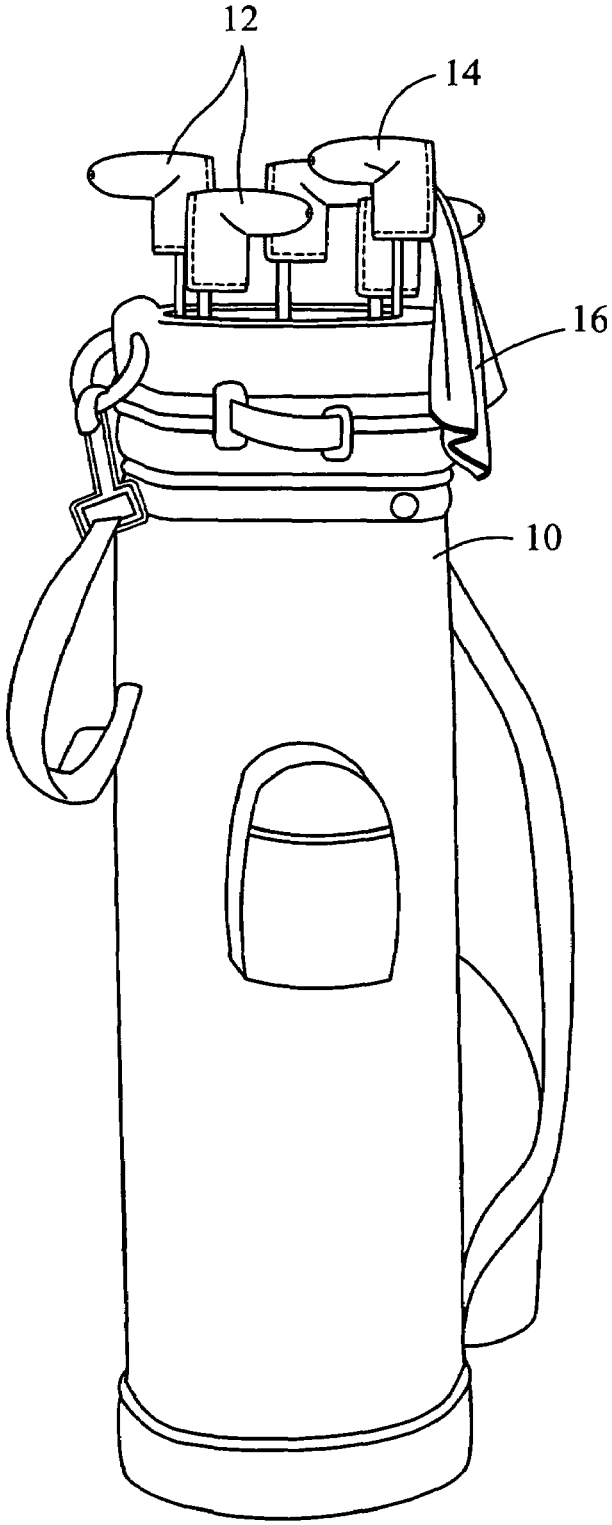
FIG. 1 is a side view of a golf bag showing an embodiment of the invention on a club stored in the bag.

Reference now should be made to the drawings, in which the same reference numbers are used throughout the different figures to designate the same or similar components. FIG. 1 shows a typical golf bag 10, which may be used to store a number of different golf clubs, each shown in FIG. 1 as covered by head covers 12 and 14. FIG. 1 also shows a wiper or towel 16 which is releasably attached to the head cover 14, illustrated in the remainder of the figures as a putter head cover.

Figure 2:
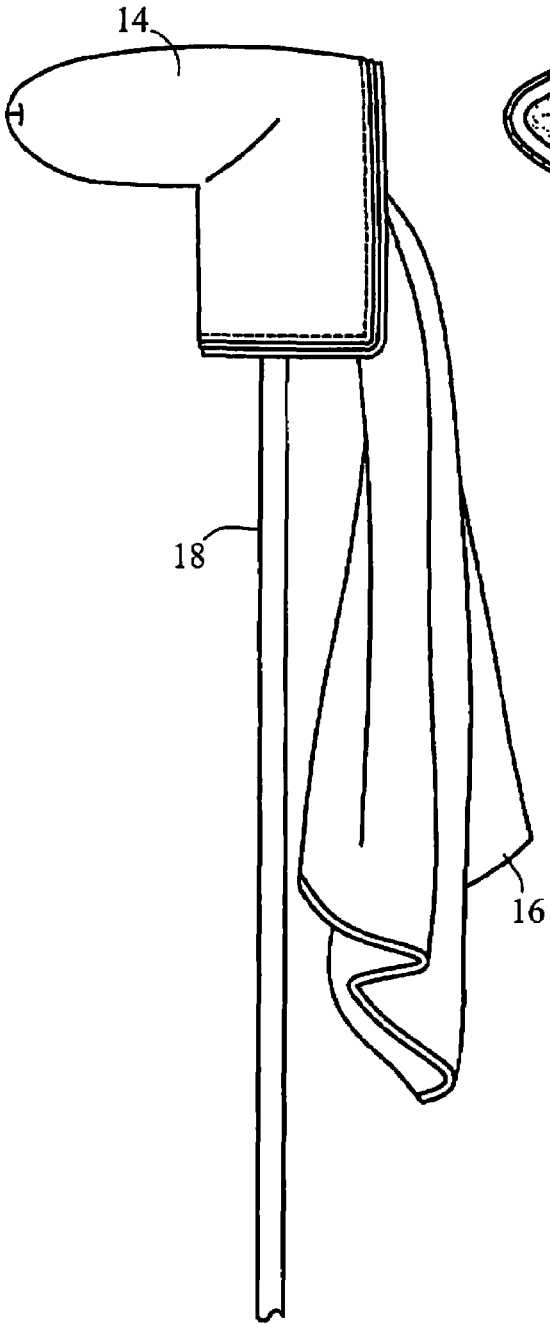
FIG. 2 is an enlarged side view of an embodiment of the invention.
Figure 4:
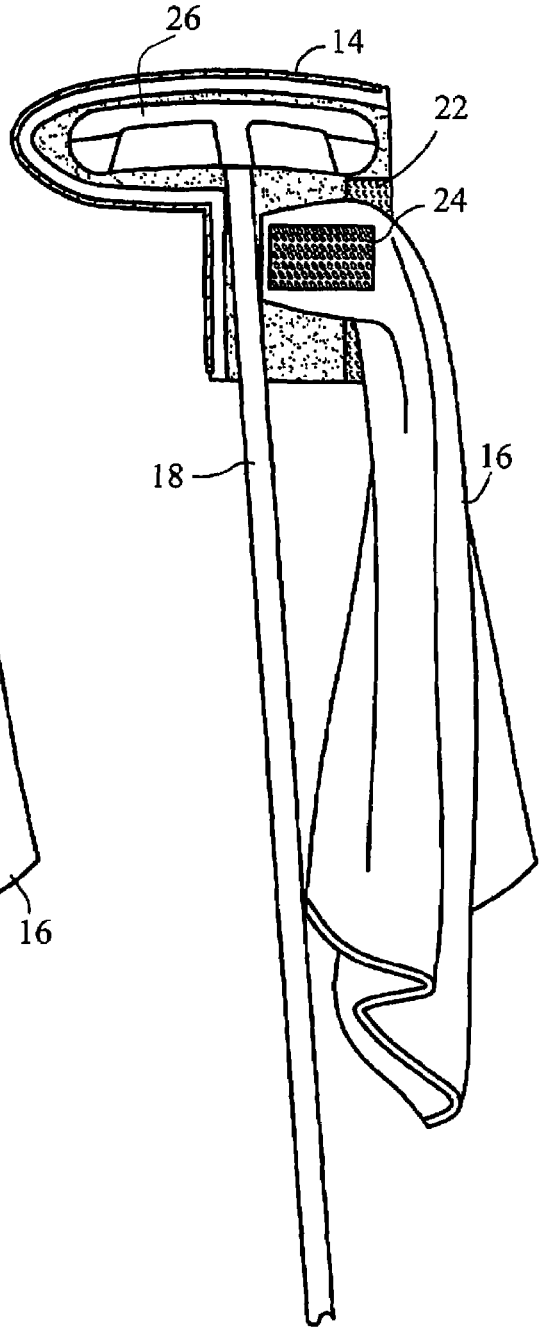
FIG. 4 is a cross-sectional view taken along the line 4-4 of FIG. 3.
Figure 3:
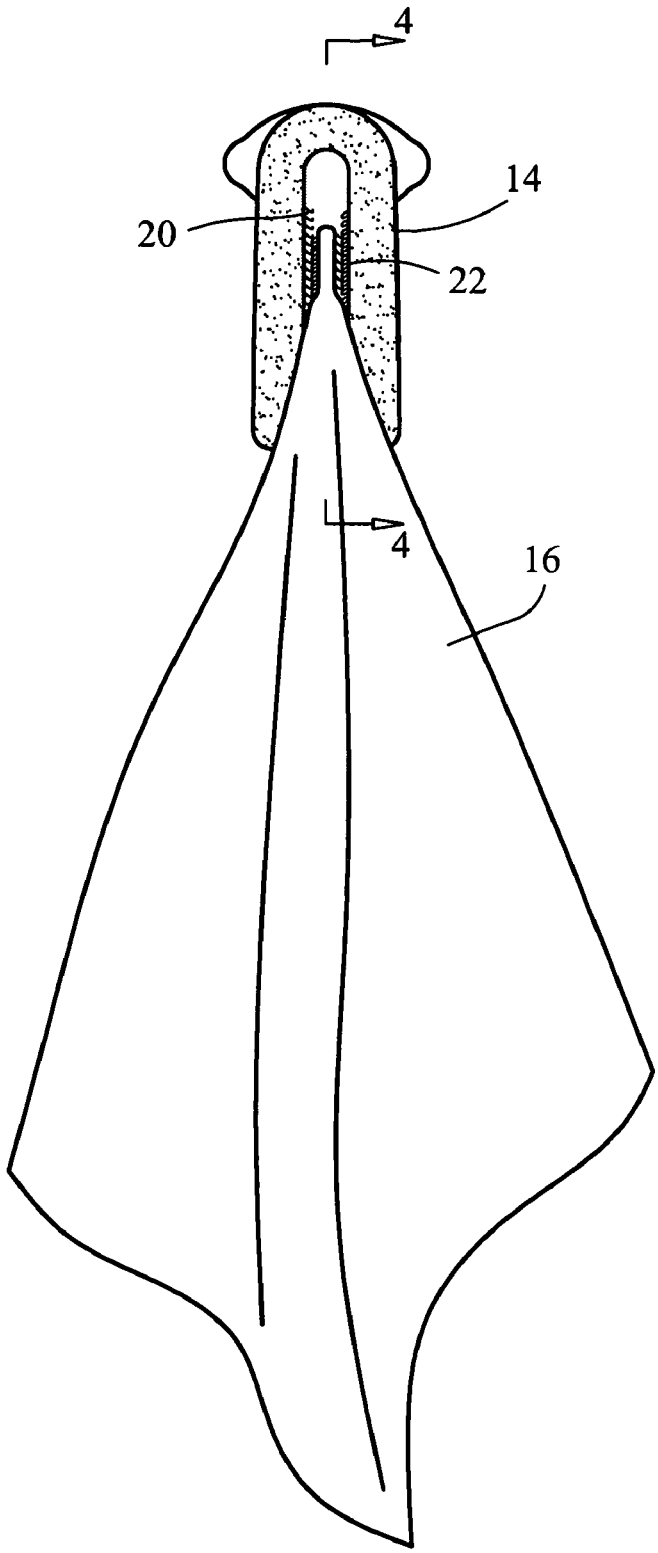
FIG. 3 is a rear view of the embodiment shown in FIG. 2.

FIG. 2 is a side view of the putter head cover 14 placed over and surrounding a putter head, with the shaft 18 of the putter extending outwardly from the cover 14. The cover 14 ideally is made in the configuration of the putter head cover of U.S. Pat. No. 4,898,222, the specification of which is incorporated herein by reference, in its entirety. FIGS. 3 and 4 show additional details of the head cover 14, which is open along its back or "heel" edge from the bottom of the putter head, such as the head 26 shown in FIG. 4, and extending upwardly a short distance along the shaft 18.

As noted in U.S. Pat. No. 4,898,222, the head cover 14 has a pair of elongated mating hook-and-loop fastener strips such as VELCRO® strips 20 and 22 located on opposite facing sides of the open back. When the head cover 14 is secured onto a putter head 26, such as shown in FIGS. 1 and 2, the mating strips 20 and 22 engage one another to releasably hold the putter cover 14 in place on the putter head. Pulling open the strips 20 and 22 to disengage them opens the back of the putter cover 14 to allow removal of the putter 26 and the shaft 18 from the cover 14, which then may be placed aside during the time the putter is used by the golfer.

Figure 5:
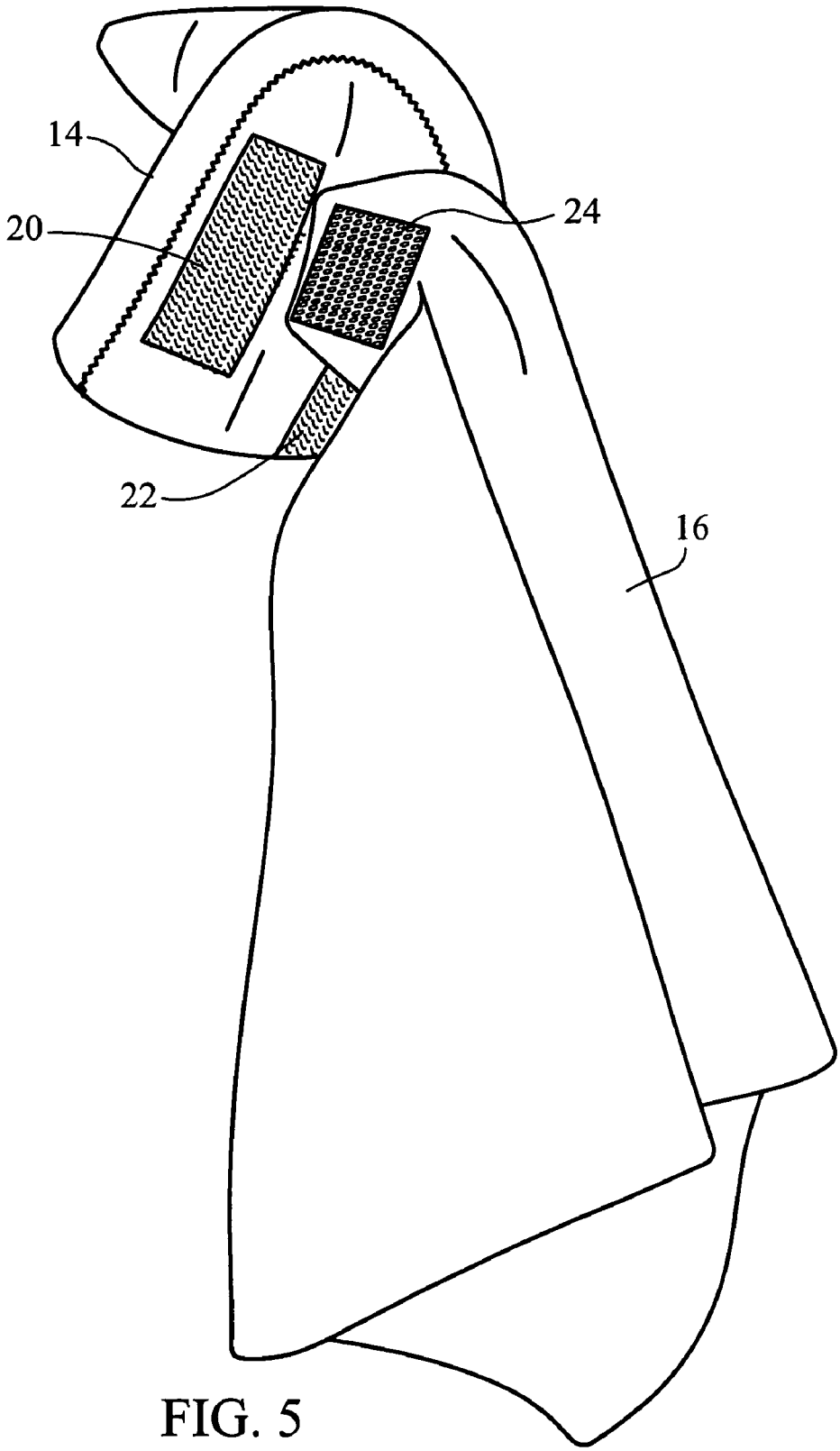
FIG. 5 is a perspective view illustrating features of the embodiment of FIGS. 2,3 and 4.

As illustrated in FIGS. 3,4 and 5 in particular, the putter cover of U.S. Pat. No. 4,898,222 is used to also releasably hold a terry towel or other suitable absorbent wiper 16 in position for ready access, as illustrated in FIG. 1. This is accomplished by placing a small square of universal hook-and-loop fastener 24 on the opposite sides of a corner of the towel 16. This corner of the towel with the universal hook-and-loop fastener 24 on each side of the towel then is placed between a portion of the mating strips 20 and 22, and engages one or both of those strips to hold the towel 16 in place on the putter cover as shown in FIGS. 3 and 4. The portions of the strips 20 and 22, which do not engage the smaller squares 24, engage one another, holding the remainder of the putter cover on the putter head 26 and shaft 18 in the manner described in U.S. Pat. No. 4,898,222.

FIG. 4 is a cross section which has removed the side of the putter cover 14 carrying the strip 20 on it to indicate a possible positioning of the strip 24 and the towel 16 on the putter cover 14, along with the shaft 18 and the putter head 26. Even with one side removed, such as the side carrying the hook or loop strips 20, the opposing fastener square 24 on the opposite side of the towel 16 from that shown in FIG. 4 engages and is held by the other fastener strip 22. Typically, when the putter cover 14 is opened, the towel 16 remains attached to one or the other of the strips 20 and 22, from which it readily can also be removed, if desired. It is not necessary, however, to remove the towel 16 entirely from the putter cover 14 in order to use it, once the putter cover 14 has been removed from the putter, as described above.

FIG. 5 is a partial perspective view showing the putter cover 14 opened, with the putter 26 removed to show the exposed one of the hook-and-loop fastener elements 20 disengaged from the universal hook/loop square 24 on the corner of the towel 16. The mating fastener 22 on the rear edge of the putter cover 14 is shown partially exposed in FIG. 5; and the square of universal hook/loop fastener 24 on the opposite side of the towel 16 (not shown in FIG. 5) remains attached to the fastener portion 22 on the putter cover.

When the towel 16 is to be laundered, it readily can be disengaged from the releasable hook-and-loop fastener elements 20 and 22, leaving the putter cover 14 in place on the putter head 26. Alternatively, a second towel 16 immediately may be used to replace one which has been removed for laundering.

The foregoing description of an embodiment of the invention is to be considered as illustrative and not as limiting. For example, although hook-and-loop fastener elements are described in conjunction with the portions 20, 22 and 24, other fasteners, such as snap fasteners, magnetic fasteners, or the like could be used to effect the same functional operation. Various other changes and modifications will occur to those skilled in the art for performing substantially the same function, in substantially the same way, to achieve substantially the same result, without departing from the true scope of the invention as defined in the appended claims.

What is claimed is:

1. A towel and head cover for golf club irons or putters including in combination: a head cover comprising a first body portion made of flexible material and shaped to encase a golf club head having a toe and heel, the first body portion having a toe end and a heel end and being open on the heel end thereof; a second body portion of the head cover having first and second ends, with the first end thereof attached to the first body portion at the heel end thereof and substantially at right angles thereto for encasing at least a portion of the shaft of a golf club where the shaft is attached to the head, the second body portion being open on the second end and open on the side thereof adjacent the opening in the first body portion to form a single continuous opening within the head cover; first and second mating fasteners located, respectively, on opposite sides of the inside of the second body portion adjacent the opening on the side thereof, for releasably closing the opening on the side of the second body portion to secure it around a shaft of a club, leaving the heel end of the first body portion open when the head of a club is inserted into the first body portion, with a shaft extending through the opening in the second end of the second body portion; a towel member having a third mating fastener thereon adjacent an edge of the towel member for releasable engagement with a portion of at least one of the first and second mating fasteners to releasably hold the towel member on the head cover when the head cover is on the head of a golf club and when the head cover is removed from the head of a golf club, wherein the second body portion is elongated to surround a portion of the shaft of a golf club, with the first and second mating fasteners extending along the length of the opening of the side thereof which parallels the axis of a golf club shaft, and wherein the third mating fastener engages only a portion of either the first or second mating fastener on the second body portion of the head cover, wherein the towel member has the third mating fastener thereon on one side thereof and a fourth mating fastener thereon adjacent an edge of the towel member on an opposite side thereof.

2. The combination according to claim 1 wherein the third and fourth mating fasteners on the towel member are located directly opposite one another on opposite sides of the towel member.

3. A combination according to claim 2 wherein the first, second and third mating fasteners are hook-and-loop fasteners.

4. A combination according to claim 3 wherein the towel member is rectangular and the third mating fastener on the towel member is located adjacent a corner of the towel member.

5. A combination according to claim 4 wherein the width of the second body portion in a plane perpendicular to the plane of a shaft of a golf club inserted therein is greater than the diameter of a golf club shaft and the first and second mating fasteners extend substantially from the open edge of the second body portion to a point near the opposite side thereof and are spaced from such opposite side a distance at least equal to the diameter of a golf club shaft.

6. The combination according to claim 5 wherein the first and second mating fasteners comprise first and second strips of fastening material attached, respectively, on each side of the opening on the side of the second body portion, with the first strip comprising a plurality of hooks projecting therefrom and the second strip comprising a plurality of loops adapted to co-act with the hooks to releasably close the opening in the side of the second body portion when the strips of fastening material are pressed together.

7. The combination according to claim 6 wherein the fourth mating fastener on the towel member comprises hook-and-loop fastener members for engaging one of the first and second mating fasteners on the second body portion.

8. A towel and head cover for golf club irons or putters including in combination: a head cover comprising a first body portion made of flexible material and shaped to encase a golf club head having a toe and heel, the first body portion having a toe end and a heel end and being open on the heel end thereof; a second body portion of the head cover having first and second ends, with the first end thereof attached to the first body portion at the heel end thereof and substantially at right angles thereto for encasing at least a portion of the shaft of a golf club where the shaft is attached to the head, the second body portion being open on the second end and open on the side thereof adjacent the opening in the first body portion to form a single continuous opening within the head cover; first and second mating fasteners located, respectively, on opposite sides of the inside of the second body portion adjacent the opening on the side thereof, for releasably closing the opening on the side of the second body portion to secure it around a shaft of a club, leaving the heel end of the first body portion open when the head of a club is inserted into the first body portion, with a shaft extending through the opening in the second end of the second body portion; a towel member having a third mating fastener thereon adjacent an edge of the towel member for releasable engagement with a portion of at least one of the first and second mating fasteners to releasably hold the towel member on the head cover when the head cover is on the head of a golf club and when the head cover is removed from the head of a golf club, wherein the first and second mating fasteners comprise first and second strips of fastening material attached, respectively, on each side of the opening on the side of the second body portion, with the first strip comprising a plurality of hooks projecting therefrom and the second strip comprising a plurality of loops adapted to co-act with the hooks to releasably close the opening in the side of the second body portion when the strips of fastening material are pressed together, wherein the second body portion is elongated to surround a portion of the shaft of a golf club, with the first and second mating fasteners extending along the length of the opening of the side thereof which parallels the axis of a golf club shaft, and wherein the third mating fastener engages only a portion of either the first or second mating fastener on the second body portion of the head cover, wherein the towel member has the third mating fastener thereon on one side thereof and a fourth mating fastener thereon adjacent an edge of the towel member on an opposite side thereof.

9. The combination according to claim 8 wherein the third and fourth mating fasteners on the towel member are located directly opposite one another on opposite sides of the towel member.

10. The combination according to claim 9 wherein the third and fourth mating fasteners on the towel member comprise hook-and-loop mating fastener members for engaging corresponding ones of the first and second fasteners on the second body portion.

11. A towel and head cover for golf club irons or putters including in combination: a head cover comprising a first body portion made of flexible material and shaped to encase a golf club head having a toe and heel, the first body portion having a toe end and a heel end and being open on the heel end thereof; a second body portion of the head cover having first and second ends, with the first end thereof attached to the first body portion at the heel end thereof and substantially at right angles thereto for encasing at least a portion of the shaft of a golf club where the shaft is attached to the head, the second body portion being open on the second end and open on the side thereof adjacent the opening in the first body portion to form a single continuous opening within the head cover; first and second mating fasteners located, respectively, on opposite sides of the inside of the second body portion adjacent the opening on the side thereof, for releasably closing the opening on the side of the second body portion to secure it around a shaft of a club, leaving the heel end of the first body portion open when the head of a club is inserted into the first body portion, with a shaft extending through the opening in the second end of the second body portion; a towel member having a third mating fastener thereon adjacent an edge of the towel member for releasable engagement with a portion of at least one of the first and second mating fasteners to releasably hold the towel member on the head cover when the head cover is on the head of a golf club and when the head cover is removed from the head of a golf club, wherein the towel member is rectangular and the third mating fastener on the towel member is located adjacent a corner of the towel member, wherein the towel member has the third mating fastener thereon on one side thereof and a fourth mating fastener thereon adjacent an edge of the towel member on an opposite side thereof.

12. The combination according to claim 11 wherein the third and fourth mating fasteners on the towel member are located directly opposite one another on opposite sides of the towel member.

* * * * *